United States Patent [19]

Wahle et al.

[11] Patent Number: 4,593,704

[45] Date of Patent: Jun. 10, 1986

[54] METHOD OF AND APPARATUS FOR BUILDING A COMPOSITE TOBACCO STREAM

[75] Inventors: Günter Wahle, Reinbek; Dieter Ludszeweit; Uwe Heitmann, both of Hamburg, all of Fed. Rep. of Germany

[73] Assignee: Hauni-Werke Körber & Co. KG., Hamburg, Fed. Rep. of Germany

[21] Appl. No.: 557,733

[22] Filed: Dec. 2, 1983

[30] Foreign Application Priority Data

Dec. 2, 1982 [DE] Fed. Rep. of Germany ..... 3244535

[51] Int. Cl.[4] ..... A24C 5/18; A24C 5/39

[52] U.S. Cl. ..... 131/84.3; 131/84.4; 131/108

[58] Field of Search ..... 131/84 R, 84 A, 84 B, 131/84 C, 108, 109 R, 364

[56] References Cited

U.S. PATENT DOCUMENTS

| | | | |
|---|---|---|---|
| 3,736,941 | 6/1973 | Molins et al. | 131/84 C |
| 3,795,249 | 3/1974 | Cristiani | 131/84 C |
| 3,987,804 | 10/1976 | Molins et al. | 131/84 B |
| 4,175,570 | 11/1979 | Heitmann | 131/108 |
| 4,256,125 | 3/1981 | Labbe | 131/84 C |

*Primary Examiner*—Vincent Millin
*Assistant Examiner*—H. Macey
*Attorney, Agent, or Firm*—Peter K. Kontler

[57] ABSTRACT

A composite tobacco stream is built at the underside of the lower reach of an air-permeable belt conveyor below a suction chamber by showering tobacco particles of a first type into the corner between one marginal portion of the lower reach and a first sidewall bounding a tobacco channel at the underside of the lower reach, by thereupon showering tobacco particles of the first type into the corner between the other marginal portion of the lower reach and a second sidewall so that the particles form a first tobacco layer having a concave underside, by thereupon depositing a relatively narrow core consisting of tobacco particles of a different second type on the underside of the first layer midway between and spaced apart from the two marginal portions of the lower reach, and by thereupon showering tobacco particles of the first type over the core as well as over the marginal portions of the first layer. The core can be formed by showering tobacco particles of the second type directly against the central zone of the concave underside of the first layer, or by building the core on a separate conveyor and transferring the thus formed core onto the first layer.

40 Claims, 8 Drawing Figures

METHOD OF AND APPARATUS FOR BUILDING A COMPOSITE TOBACCO STREAM

CROSS-REFERENCE TO RELATED CASES

The apparatus which is disclosed in the present application is somewhat similar to those disclosed in the commonly owned copending application Ser. No. 537,732 filed Dec. 2, 1983 by Uwe Heitmann, in the commonly owned copending application Ser. No. 557,641 filed Dec. 2, 1983 by Uwe Heitmann, in the commonly owned copending application Ser. No. 557,732 filed Dec. 2, 1983 by Güunter Wahle et al., and in the commonly owned copending application Ser. No. 392,775 filed June 28, 1982 by Guido Quarella.

BACKGROUND OF THE INVENTION

The present invention relates to a method of and to an apparatus for the making of a continuous tobacco stream. More particularly, the invention relates to improvements in a method of and in an apparatus for the making of a tobacco stream which contains different types of tobacco. Still more particularly, the invention relates to improvements in a method of and in an apparatus for the making of a composite tobacco stream wherein a core consisting of or containing a first type of tobacco is surrounded by a tubular envelope or shell consisting of or containing a second type of tobacco.

It is already known to form a tobacco stream wherein a core containing tobacco particles of a first type is confined in a tubular envelope consisting of tobacco particles of a second type. In accordance with heretofore known proposals, such tobacco stream is obtained by showering a first tobacco layer onto the exposed side of an air-permeable conveyor the other side of which is adjacent to a suction chamber so that the pressure differential suffices to attract the first layer to the exposed side of the conveyor. The conveyor constitutes the mobile bottom wall of an elongated tobacco channel which further includes two sidewalls and has a substantially square or rectangular cross-sectional outline. In the next step, a relatively narrow second tobacco layer (consisting of a material other than the material of the first layer) is showered onto the first layer so that the marginal portions of the first layer extend laterally beyond the second layer. In a further step, the channel receives a third tobacco layer whose material is identical with that of the first layer and which overlies the second layer as well as the marginal portions of the first layer. The first and third layers form an envelope for the second layer. Reference may be had, for example, to German Offenlegungsschrift No. 20 15 387 and to German Pat. No. 22 46 976. The Offenlegungsschrift discloses an apparatus wherein the first tobacco layer is originally flat and is thereupon deformed by appropriate shaping of the path for the air-permeable conveyor so that the thus deformed first layer exhibits an exposed concave surface and constitutes a substantially trough- or gutter-shaped receptacle for the narrower second layer. The conversion of the originally flat first tobacco layer into a gutter-shaped layer is assisted by a needle-like shaping tool which engages the exposed side of the first layer during deformation of the conveyor. The introductory part of the aforementioned German patent discloses that such conversion of an originally flat tobacco layer into a concavo-convex layer presents or is likely to present problems and, in order to eliminate such problems, the German patent proposes to install in the tobacco channel a partition which divides the mass of showered tobacco particles and is spaced apart from the exposed side of the conveyor by a distance corresponding to the desired thickness of the central longitudinal portion of the first tobacco layer, namely, of that portion which is to be overlapped by the second tobacco layer. The purpose of the partition is to prevent the penetration of tobacco particles, which are to form the first layer, into that zone of the channel which is about to receive the particles constituting the second layer. A drawback of such proposal is that the partition increases the likelihood of clogging of the tobacco channel.

OBJECTS AND SUMMARY OF THE INVENTION

An object of the invention is to provide a novel and improved method of building a composite tobacco stream, wherein a core consisting of or containing tobacco particles of a first type is surrounded by an envelope which consists of or contains tobacco particles of a second type, which ensures the making of such a stream at a high rate of speed, with a high degree of predictability and reproducibility, and without the likelihood of clogging the tobacco channel.

Another object of the invention is to provide a method which ensures the formation of a first tobacco layer having a configuration which is best suited for reception and centering of the second tobacco layer, i.e., of the layer which is to constitute the core of the finished product.

A further object of the invention is to provide a method which can be practiced in relatively simple and compact apparatus and which can be resorted to for the making of a continuous composite tobacco stream at a rate which is required in modern high-speed cigarette making or analogous machines.

An additional object of the invention is to provide a novel and improved apparatus for the practice of the above outlined method and to construct and assemble the apparatus in such a way that a first tobacco layer with a concave exposed surface can be formed without a conveyor which must be deformed for such purpose and/or without special tools and/or partitions in the interior of the tobacco channel.

Still another object of the invention is to provide the apparatus with novel and improved means for forming the first, second and third layers of the tobacco stream.

An additional object of the invention is to provide an apparatus which can be used in existing cigarette rod making and analogous machines as a superior substitute for heretofore known tobacco stream-forming apparatus.

Another object of the invention is to provide the apparatus with novel and improved means for directing particles of tobacco toward selected portions of an air-permeable conveyor at the bottom of the tobacco channel.

One feature of the invention resides in the provision of a method of producing a composite tobacco stream on an elongated air-permeable conveyor having first and second sides and longitudinally extending first and second marginal portions. The method comprises the steps of moving the conveyor lengthwise in a predetermined direction, establishing a pressure differential between the two sides of the conveyor so that air flows from the first to the second side, supplying particles consisting of or containing a first type of tobacco largely or predominantly onto the marginal portions of the first side of the conveyor whereby the particles are retained on the conveyor as a result of establishment of the pressure differential and form on the conveyor a first tobacco layer having an at least substantially concave surface facing away from the first side, covering the central portion of the concave surface of the first layer with a core consisting of or containing tobacco particles of a second type and having a width which is less than that of the first tobacco layer so that portions of the concave surface at the opposite sides of the core remain exposed, and applying over the core and over the exposed portions of the concave surface a second layer of tobacco particles, preferably tobacco particles of the first type, so that the core is at least substantially confined between the first and second tobacco layers. It is further within the purview of the invention to form a second layer consisting of or containing tobacco particles of a third type.

The supplying step comprises or can comprise transporting tobacco particles of the first type in streams of compressed air and directing the streams of compressed air toward the marginal portions of the first side of the conveyor. In accordance with a presently preferred embodiment of the method, the supplying step comprises directing particles of tobacco against the first and second marginal portions of the one side of the conveyor at first and second locations which are disposed one after the other, as considered in the predetermined direction (i.e., the two locations are staggered with reference to each other, as considered in the direction of travel of the first tobacco layer with the conveyor).

The method preferably further comprises the step of intensifying the flow of air through the conveyor at the aforementioned locations, i.e., of attracting tobacco particles of the first type with a greater force in those regions where such particles come in contact with the first side of the conveyor or with tobacco particles which are already attracted to the first side of the conveyor.

The covering step can comprise showering tobacco particles of the second type and attracting the thus showered tobacco particles of the second type to the conveyor by suction. The showering step can comprise transporting tobacco particles of the second type in at least one directed stream of compressed air. In accordance with one presently preferred embodiment of the invention, the covering step comprises showering (including propelling) tobacco particles of the second type directly onto the concave surface of the first tobacco layer. In accordance with a modification of the method, the core is formed on a second elongated air-permeable conveyor which is narrower than the first conveyor (i.e., at least that portion of the second conveyor which is to accumulate tobacco particles forming the core is narrower than the effective part of the first side of the first conveyor) and has first and second sides. Such core-forming step then comprises moving the second conveyor lengthwise in a preselected direction (which may but need not be the same as the predetermined direction of movement of the first conveyor), establishing a pressure differential between the two sides of the second conveyor so that air flows from the first to the second side of the second conveyor, and supplying tobacco particles of the second type onto the first side of the second conveyor. The step of supplying tobacco particles of the second type can comprise transporting such particles in one or more streams of compressed air and directing the stream of streams of compressed air toward the first side of the second conveyor. The just mentioned supplying step can include supplying tobacco particles of the second type with a surplus (i.e., in excess of the requirements of the composite stream), and the method then further comprises removing the surplus from the core prior to the covering step (i.e., prior to deposition of the trimmed core on the concave surface of the first tobacco layer) so that the trimmed or equalized core has a predetermined cross-sectional outline (e.g., a square or rectangular cross-sectional outline). The covering step can comprise transferring the trimmed core from the second conveyor onto the concave surface of the first tobacco layer on the first conveyor and pressing the transferred core against the first layer (the core thereupon remains on the first conveyor as a result of the establishment of pressure differential between the first and second sides of the first conveyor). A first tobacco channel is preferably established at the first side of the first conveyor, and a second tobacco channel can be established at the first side of the second conveyor; the transferring step then preferably includes gradually lifting the core out of the second channel. The aforementioned step of supplying tobacco particles of the second type to the first side of the second conveyor can comprise establishing a source of tobacco particles of the second type (e.g., in a duct which receives satisfactory tobacco particles from a classifying device), introducing tobacco particles of the second type from the source into an arcuate path which can be defined by the concave side of a guide wall and terminates short of the second channel, and admitting into the arcuate path streams of compressed air which serve to propel the particles of the second type toward the second conveyor so that each particle of the second type has a trajectory extending across the second channel between the arcuate path and the second conveyor. Some compressed air can be withdrawn from the second channel by a route other than through the air-permeable second conveyor (e.g., through one or more air-permeable portions of one or both sidewalls which cooperate with the second conveyor to define the second channel). Each stream of compressed air is preferably imparted a component of movement in the preselected direction to thus reduce the likelihood of rebounding or other stray movements of tobacco particles of the second type when they impinge upon the second conveyor or upon the particles which are already attracted to the second conveyor.

Irrespective of whether the core is formed directly on the concave surface of the first tobacco layer or on a discrete second conveyor, at least one of the supplying, covering and applying steps (to respectively form the first tobacco layer, the core and the second tobacco layer) includes establishing a source of tobacco particles of the respective type, introducing tobacco particles from the source into an arcuate path which terminates at the channel (that is adjacent to the first side of the first conveyor or to the first side of the second conveyor) short of the first side of the respective conveyor, and admitting into the arcuate path streams of compressed air to propel the particles of the respective tobacco type toward the conveyor so that each particle of the respective type has a trajectory extending across the respective channel between the arcuate path and the first side of the respective conveyor. Such method preferably further comprises the step of imparting to each stream of compressed air a component of movement in the direction of travel of the tobacco layer and/or core with the respective conveyor. Also, a certain amount of compressed air is withdrawn from the respective channel along a path other than through the adjacent conveyor. This is desirable and advantageous because compressed air is normally supplied in quantities exceeding those which can be evacuated through the air-permeable conveyor or conveyors.

Another feature of the invention resides in the provision of an apparatus for the making of a composite tobacco stream. Such apparatus can constitute the distributor in a cigarette rod making machine and comprises an elongated air-permeable conveyor which is driven to advance in a predetermined direction and has first and second sides as well as first and second longitudinally extending marginal portions, a suction generating device which is adjacent to the second side and is arranged to draw air from the first to the second side of the conveyor, sources of first and second types of tobacco particles, means for supplying tobacco particles of the first type from the respective source largely or predominantly to the marginal portions of the conveyor so as to form on the first side of such conveyor a first tobacco layer having a substantially concave surface facing away from the first side of the conveyor, means for covering the central portion of the concave surface of the first layer with tobacco particles of the second type to thus form on the first layer a core which leaves the marginal portions of the concave surface exposed at the opposite sides of the core, and means for applying over the core and over the exposed marginal portions of the concave surface a second layer preferably consisting of tobacco particles of the first type. The apparatus further comprises sidewalls which define with the conveyor an elongated tobacco channel which is adjacent to the first side of the conveyor and has a preferably rectangular or square cross-sectional outline.

The supplying means can comprise guide means for directing tobacco particles of the first type against the marginal portions of the conveyor and means (e.g., a nozzle which discharges streams of compressed air) for advancing tobacco particles of the first type along the guide means, across the tobacco channel and toward the marginal portions of the conveyor. Such guide means can comprise a first portion which serves to direct tobacco particles of the first type toward the first marginal portion of the conveyor in a first portion of the tobacco channel and a second portion which serves to direct tobacco particles of the first type toward the second marginal portion of the conveyor in a second portion of the channel downstream of the first portion, as considered in the predetermined direction (i.e., the first and second portions of the tobacco channel are staggered with reference to each other, as considered in the direction of travel of the first tobacco layer with the conveyor). The suction generating device preferably includes a suction chamber having an air-permeable wall adjacent to the second side of the conveyor, and the permeability of the wall adjacent to the two marginal portions of the conveyor in the regions of the first and second portions of the tobacco channel is preferably greater than the permeability of the remaining portions of such wall in the regions of the first and second portions of the tobacco channel so that the suction chamber attracts the oncoming tobacco particles of the first type with a force which is greater than the force which attracts the particles of the first type that already adhere to the first side of the conveyor. The wall of the suction chamber is preferably provided with holes having identical cross-sectional areas and the number of holes per unit area of those portions of the wall of the suction chamber which register with the marginal portions of the conveyor adjacent to the first and second portions of the tobacco channel exceeds the number of holes per unit area of the remaining portions of the wall in register with the first and second portions of the tobacco channel.

The covering means can comprise guide means which is arranged to direct tobacco particles of the second type against the central portion of the concave surface of the first tobacco layer substantially midway between the two sidewalls, and means (such as the aforementioned nozzle) for propelling tobacco particles of the second type from the respective source along the guide means and toward the central portion of concave surface of the first tobacco layer.

Alternatively, the covering means can comprise a second air-permeable conveyor which is driven to advance in a preselected direction and has first and second sides, a second suction generating device which serves to draw air from the first to the second side of the second conveyor, means for deliverying tobacco particles of the second type from the respective source to the first side of the second conveyor, and means for transferring the core including the tobacco particles of the second type from the second conveyor onto the central portion of the concave surface of the first tobacco layer at the first side of the first conveyor. The transferring means is disposed downstream of the supplying means, as considered in the predetermined direction. The delivering means can comprise guide means defining a preferably arcuate path for the transport of tobacco particles of the second type from the respective source toward the first side of the second conveyor and means for transporting tobacco particles of the second type along the path. Such apparatus preferably further comprises second sidewalls which are adjacent to and define with the second conveyor a second elongated tobacco channel which is adjacent to the first side of the second conveyor. The delivering means is preferably arranged to deliver a surplus of tobacco particles of the second type so that the core which is formed at the first side of the second conveyor comprises an excess of tobacco, and the apparatus then further comprises a trimming or equalizing device which serves to remove the surplus of tobacco particles from the core on the second conveyor, i.e., prior to transfer of the core onto the first tobacco layer at the first side of the first conveyor. The aforementioned transferring means preferably includes means for advancing the second conveyor along a path which extends in the predetermined direction and for causing the two conveyors to converge so as to thereby effect the transfer of the core from the second conveyor onto the first tobacco layer. Such advancing means can comprise means for gradually expelling the core from the tobacco channel which is adjacent to the first side of the second conveyor. This second conveyor can comprise an endless flexible band having a first reach which is adjacent to the second tobacco channel and a second reach which is adjacent to the first side of the first conveyor. The second reach preferably extends into the tobacco channel which is adjacent to the first side of the first conveyor. The transferring means preferably further comprises a plenum chamber which discharges streamlets of compressed air from the second to the first side of the second conveyor to thereby promote or assist in the transfer of successive increments of the core from the second conveyor onto the central portion of the concave surface of the first tobacco layer.

At least one of the aforementioned supplying, covering and applying means preferably comprises a source of compressed air and means (such as the aforementioned nozzle) for directing streams of compressed air from such source into the path of tobacco particles which are supplied by the respective tobacco sources. The directing means preferably comprises means for imparting to the air streams a component of movement in the predetermined direction to thus reduce the likelihood of rebounding or other stray movements of tobacco particles which impinge upon the respective conveyor or upon the tobacco particles which already adhere to the respective conveyor as a result of the establishment of a pressure differential between the first and second sides of the conveyor. Such apparatus preferably further comprises guide means defining for the particles of tobacco an arcuate path which extends from the respective sources of tobacco to the tobacco channel at the first side of the first conveyor but short of the first side of the first conveyor. Imaginary lines which extend tangentially of the arcuate path and toward the first conveyor intersect selected portions of the first conveyor, e.g., the marginal portions and the central portion of the first conveyor (these are the locations where the apparatus builds the first tobacco layer and the core).

At least one of the sidewalls which are adjacent to the first conveyor has at least one outwardly recessed air-permeable portion which serves to permit evacuation of some compressed air from the first tobacco channel. Such apparatus preferably comprises a suction chamber which is outwardly adjacent to the recessed portion of the one sidewall and serves to draw air from the tobacco channel at the first side of the first conveyor. A similar arrangement can be resorted to for withdrawal of surplus compressed air from the tobacco channel which is adjacent to the first side of the second conveyor if the apparatus forms the core on a second conveyor rather than directly on the concave surface of the first tobacco layer.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
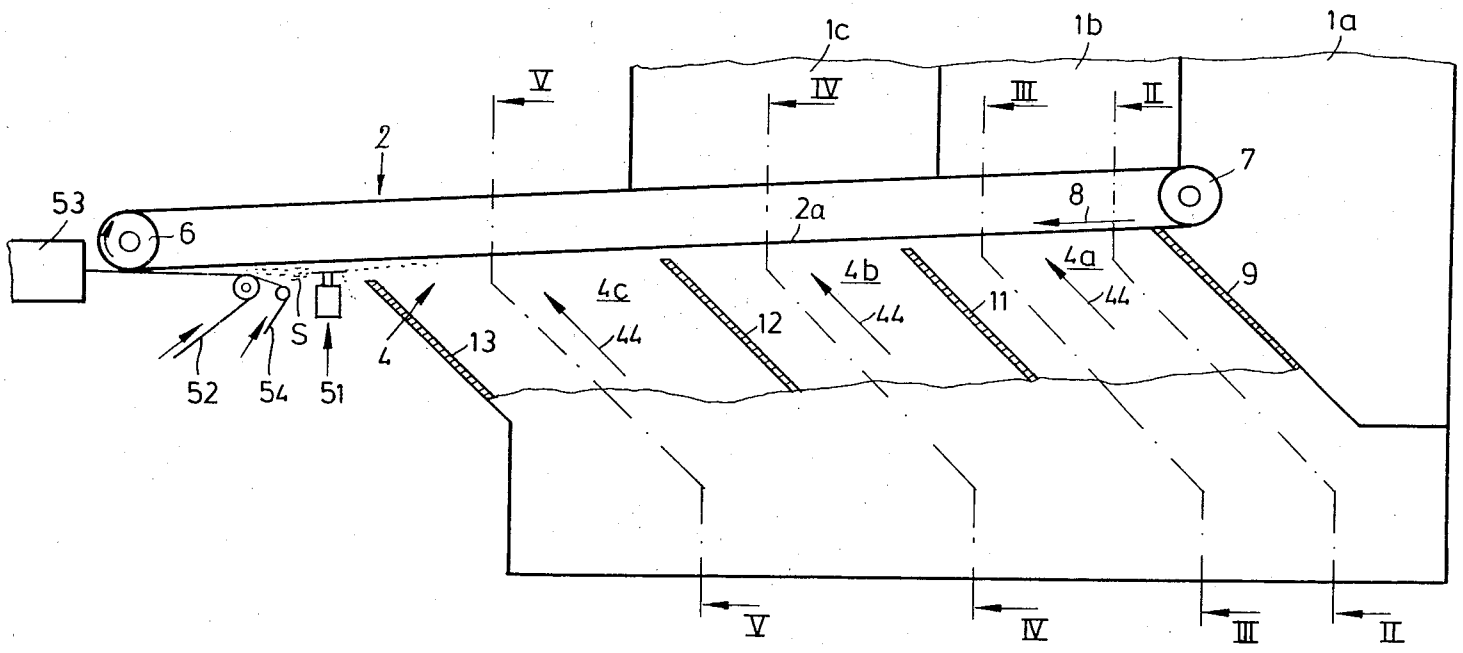
FIG. 1 is a schematic longitudinal vertical sectional view of an apparatus (e.g., a distributor in a cigarette rod making machine) which embodies one form of the invention and wherein the particles of tobacco which form the core of the composite tobacco stream are showered or propelled directly onto the concave side of the first tobacco layer.

FIGS. 1 to 5 show a portion of a cigarette rod making machine which comprises a composite distributor including a first distributor 1*a*, a second distributor 1*b* and a third distributor 1*c*. The construction of each of these distributors can be similar or analogous to that of the distributor which is disclosed in commonly owned U.S. Pat. No. 4,185,644 granted Jan. 29, 1980 to Uwe Heitmann et al. The distributors 1*a* and 1*c* supply tobacco particles of a first type, and the distributor 1*b* supplies tobacco particles of a different second type. The particles of tobacco are advanced toward and are deposited on the lower reach 2*a* of an endless flexible belt-like air-permeable conveyor 2 which is trained over pulleys 6, 7 and is driven so that its lower reach 2*a* advances in the direction of arrow 8. As can be seen in FIGS. 2 to 5, the lower reach 2*a* of the conveyor 2 is adjacent to the underside of a perforated bottom wall 37 forming part of a stationary suction chamber 38 connected to the intake 39 of a blower 41. The pressure differential which is established by the suction chamber 38 between the upper side and the underside of the lower reach 2*a* suffices to ensure that the particles of tobacco adhere to and share the movement of the lower reach 2*a* in the direction of arrow 8. The lower reach 2*a* of the conveyor 2 constitutes the bottom wall of an elongated tobacco channel 4 which is flanked by two upright sidewalls 28, 29.

The arrangement may be such that the distributors 1*a* and 1*c* deliver shreds of a first type of tobacco and that the distributor 1*b* delivers tobacco particles of a second type (e.g., a mixture of two or more blends of tobacco, so-called short tobacco and/or particles of substitute tobacco).

The channel 4 includes three sections or portions 4*a*, 4*b* and 4*c* which respectively receive tobacco particles from the corresponding distributors 1*a*, 1*b* and 1*c*. The sidewalls 28, 29 flank the longitudinally extending marginal portions of the lower reach 2*a* of the air-permeable conveyor 2, and the apparatus comprises additional or transverse walls 9, 11, 12 and 13 which cooperate to subdivide the channel 4 into the aforementioned sections or portions 4*a*, 4*b* and 4*c*. As can be seen in FIG. 1, the portion 4*a* of the channel 4 is flanked by the transverse walls 9, 11, the portion 4*b* is flanked by the walls 11, 12, and the portion 4c is flanked by the walls 12, 13.

Figure 2:
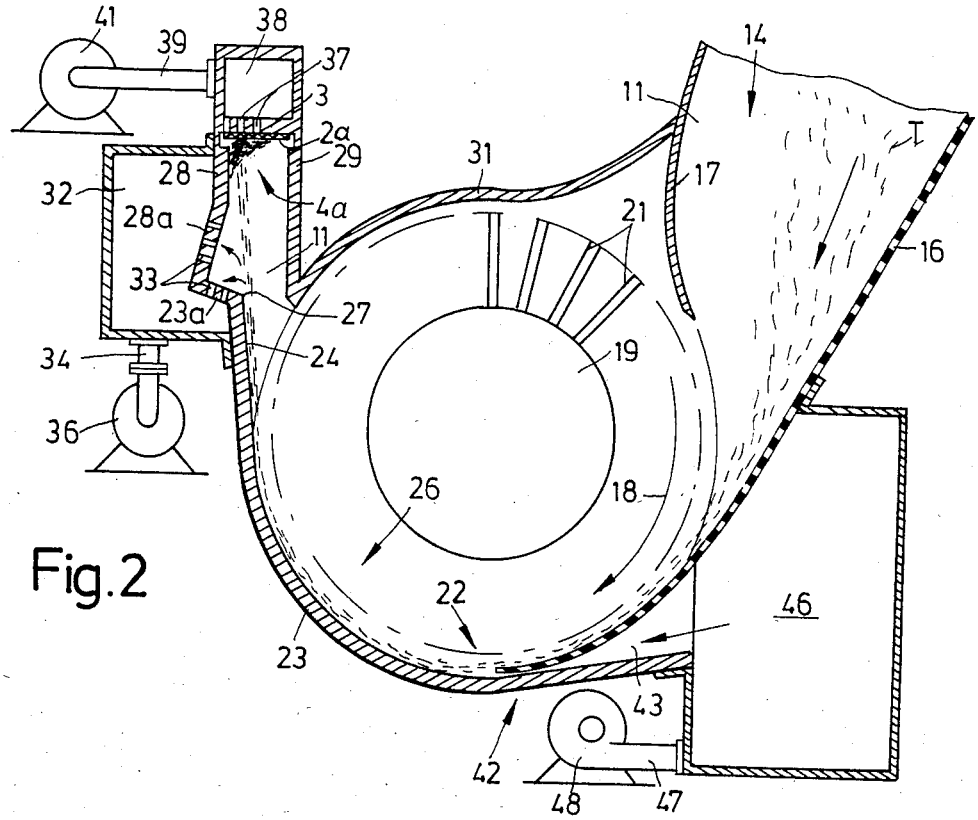
FIG. 2 is an enlarged transverse vertical sectional view, as seen in the direction of arrows from the line II—II of FIG. 1, and shows the manner of building one-half of the first tobacco layer.

FIG. 2 shows that particles T of tobacco are showered into a duct 14 which can be said to constitute a source of tobacco particles for the portion 4a of the tobacco channel 4. The duct 14 is defined by walls 16, 17, by the transverse walls 9 and 11 (only the transverse wall 11 can be seen in FIG. 2), and by a rotary carded drum-shaped conveyor 19 having a carding consisting of radially outwardly extending pins 21. The conveyor 19 is driven (see the arrow 18) to rotate at a constant speed and the partitions 11 and 12 are interrupted in the region of the conveyor 19. The curvature of the lower portion of the wall 16 shown in FIG. 2 matches or approximates the curvature of the endless path for the tips of the pins 21 so as to provide for tobacco particles T a concave surface along which the particles advance into the range of pins 21 and on toward the lower end of the corresponding portion 4a of the tobacco channel 4. The end portion 22 of the wall 16 is adjacent to the concave upper side of an arcuate guide wall 23 which is connected to or made integral with the sidewall 28 of the tobacco channel 4. The curvature of the concave surface of the guide wall 23 matches or closely approximates that of the path for the tips of pins 21 on the conveyor 19. That portion of the tobacco-contacting face of the guide wall 23 which is adjacent to the sidewall 28 is flat or substantially flat, as at 24. It will be noted that the walls 16 and 23 define for tobacco particles T an elongated path 26 which is arcuate all the way to the guide face 24 and along which the particles T advance from the interior of the duct 14 into the portion 4a of the tobacco channel 4.

The sidewall 28 has an outwardly extending recessed portion 23a which is integral with the guide wall 23 and an outwardly extending recessed portion 28a which is integral with the portion 23a as well as with the vertical uppermost portion of the sidewall 28. The portions 23a and 28a are permeable to air (they are formed with openings 33) so that they establish communication between the channel 4 and a suction chamber 32 which is connected to the intake 34 of a blower 36. The lower portion of the sidewall 29 is integral with the adjacent end portion of an arcuate wall 31 whose concave side faces the conveyor 19 and has a curvature conforming that of the path of movement of the tips of pins 21. The air-permeable portion 23a of the sidewall 28 and the guide wall 23 define a horizontal edge face 27 beyond which the particles of tobacco are propelled toward the underside of the lower reach 2a of the conveyor 2.

The means for advancing tobacco particles T from the source (duct) 14 toward the channel portion 4a comprises the conveyor 19 as well as a nozzle 42 which receives compressed air from a plenum chamber 46 connected to the outlet 47 of a blower 48. The nozzle 42 extends along the full width of the arcuate path 26 and is bounded in part by guide surfaces 43 which are inclined in the direction (arrow 8) of advancement of the lower reach 2a of the conveyor 2 so that the particles T which advance beyond the end portion 22 of the arcuate wall 16 receive a component of movement in the direction in which the growing tobacco stream is transported by the lower reach 2a toward the draping station of the cigarette rod making machine. The direction in which the air streams supplied by the nozzle 42 advance the particles T in the channel portion 4a is indicated by the arrows 44 shown in FIG. 1.

Figure 3:
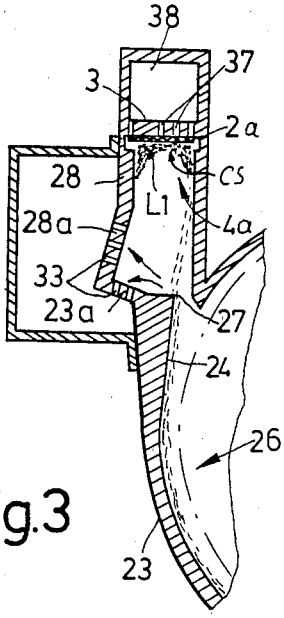
FIG. 3 is a similar transverse vertical sectional view, as seen in the direction of arrows from the line III—III of FIG. 1, and illustrates the manner of building the other half of the first tobacco layer.

The flat guide face 24 is tangential to the arcuate portion of the path 26 for tobacco particles T which advance from the duct 14 toward the channel portion 4a. The inclination of the guide face 24 varies, as considered in the direction of the arrow 8 and as shown in FIGS. 2, 3, 4 and 5. Thus, in FIG. 2, the inclination of the guide face 24 is such that it propels the particles T into the left-hand corner of the channel portion 4a in the region where the upper portion of the sidewall 28 is adjacent to the left-hand marginal portion of the lower reach 2a of the conveyor 2. This results in the accumulation of a first half of a first tobacco layer L1 along the left-hand portion of the underside of the lower reach 2a. In the region which is shown in FIG. 3 (still in the portion 4a of the channel 4), the inclination of the guide face 24 is such that it propels the particles T of tobacco from the distributor 1a upwardly toward and against the right-hand half of the underside of the lower reach 2a to thus form the second half of the first tobacco layer L1. The formation of such layer is completed in the region of the transverse wall 11, and the layer L1 exhibits a concave exposed surface CS which faces downwardly and is ideally suited for the deposition of a narrower layer or core K thereon. The development of a first layer L1 with a concave exposed surface CS is attributed to the fact that the portions of the guide face 24 which are shown in FIGS. 2 and 3 propel tobacco particles T into two different corners of the channel portion 4a, namely, against the left-hand and against the right-hand marginal portions of the underside of the lower reach 2a of the conveyor 2. This automatically entails greater accumulations of tobacco particles T adjacent to the sidewalls 28, 29 than in the region midway between such sidewalls. The inertia of tobacco particles T which are propelled by the streams of compressed air supplied by the nozzle 42 suffices to ensure that the trajectories of the particles (such trajectories begin at the edge face 27 and terminate at the underside of the lower reach 2a) are sufficiently predictable for the accumulation of tobacco particles in a manner as shown in FIGS. 2 and 3, i.e., for the formation of a first tobacco layer L1 having a concave exposed surface CS.

Figure 4:
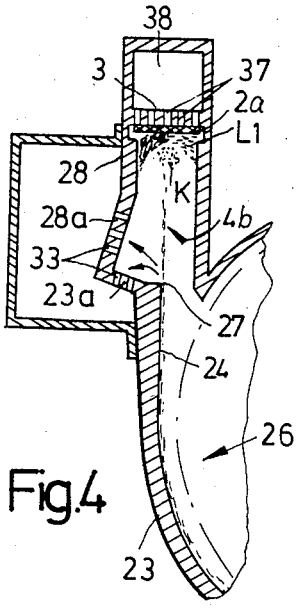
FIG. 4 is a similar transverse vertical sectional view, as seen in the direction of arrows from the line IV—IV of FIG. 1, and illustrates the manner of building the core directly at the concave underside of the first tobacco layer.

FIG. 4 shows that the portion of the guide face 24 in the portion 4b of the tobacco channel 4 directs tobacco particles of a second type toward the central or median portion of the underside of the lower reach 2a of the conveyor 2 so that the thus directed particles form a core K which overlies the central portion of the concave surface CS of the first layer L1. This means that substantially one-half of the resulting core K is already embedded in or confined by the first layer L1 whose marginal portions extend downwardly along the inner sides of the respective sidewalls 28 and 29.

Figure 5:
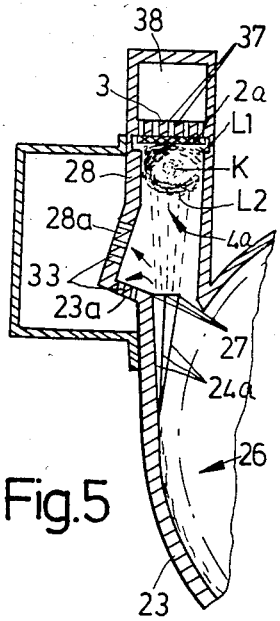
FIG. 5 is a similar transverse vertical sectional view, as seen in the direction of arrows from the line V—V of FIG. 1, and illustrates the manner of building the second tobacco layer.

Referring to FIG. 5, that portion of the guide face 24 which is located below the portion 4c of the tobacco channel 4 has several portions 24a which are staggered with reference to each other, as considered in the direction of the arrow 8 as well as transversely of such direction, so that the particles T of tobacco (which is preferably the same as that supplied into the portion 4a of the tobacco channel 4) form several partial streams which deposit along the marginal portions of the concave surface CS of the first layer L1 as well as on the lower half of the core K and together form a second layer L2 which, in combination with the layer L1, forms a tubular envelope or shell around the core K. FIG. 5 shows three staggered portions 24a of the guide face 24; however, it is equally within the purview of the invention to provide only two portions or more than three portions, depending on the desired cross-sectional outline of the second layer L2.

Referring again to FIG. 2, it will be seen that the bottom wall 3 of the suction chamber 38 has identical holes or ports 37 only in its left-hand portion, i.e., in that portion which is adjacent to the left-hand half of the lower reach 2a. This is the portion of the lower reach 2a which receives a directed partial stream of tobacco particles T from the corresponding portion of the guide face 24. In FIG. 3, the number of holes 38 in the right-hand half of the bottom wall 3 greatly exceeds the number of holes in the left-hand half to ensure actual attraction of tobacco particles T which are being propelled beyond the edge face 27 of the corresponding portion of the guide face 24. The number of holes 37 in the left-hand portion of the bottom wall 3 (none are shown in FIG. 3 in view of the scale of the drawing) is just sufficient to ensure that the left-hand portion of the first layer L1 continues to adhere to and shares the movement of the lower reach 2a while the right-hand portion of the lower reach gathers the particles which form the right-hand portion of the same layer L1.

In the portions 4b and 4c of the tobacco channel 4, the holes 37 can be equally or substantially equally distributed across the full width of the bottom wall 3 in order to adequately retain the first layer L1 while simultaneously attracting the particles of the growing core K (FIG. 4) as well as to adequately retain the layer L1 and core K while simultaneously attracting the particles of the growing second layer L2 (FIG. 5). However, it is equally within the purview of the invention to provide a larger number of holes 37 in the central portion of that part of the bottom wall 3 which is disposed above the portion 4b of the tobacco channel 4 in order to more reliably attract the particles which form the growing core K.

The mode of operation of the apparatus which is shown in FIGS. 1 to 5 is as follows:

The distributors 1a, 1b and 1c deliver tobacco particles into the duct 14 wherein the particles slide along the inner side of the wall 16 and advance toward the end portion 22 (with assistance from the pins 21 of the carded conveyor 19) to enter the streams of compressed air issuing from the nozzle 42 and flowing in the direction of arrows 44 along the concave portion of the guide face of the wall 23 toward the lower ends of the respective portions 4a, 4b, 4c of the tobacco channel 4. The particles which advance along the path 26 closely hug the concave side of the guide wall 23 and advance toward, along and beyond the corresponding portions of the flat guide face 24. Such portions of the guide face 24 determine the direction of travel of tobacco particles beyond the respective portions of the edge face 27, i.e., across the channel 4 and toward and against the underside of the lower reach 2a of the conveyor 2 or against the particles which already adhere to the lower reach 2a (due to the pressure differential which is established by the suction chamber 38) to form portions of the first layer L1, core K or second layer L2.

The major percentage of gaseous carrier medium (air) which is supplied by the nozzle 42 (i.e., by the plenum chamber 46) is evacuated by way of openings 33 in the portions 23a, 28a of the sidewall 28. The feature that the wall portions 23a and 28a are recessed outwardly and away from the trajectories of the nearest partial tobacco streams which advance beyond the corresponding portions of the edge face 27 ensures that the trajectories of tobacco particles in the channel portions 4a, 4b and 4c are not affected at all or are not unduly affected by the streamlets of air which leave the channel 4 via openings 33. Moreover, such recessing of the portions 23a, 28a of the sidewall 28 ensures the the openings 33 are not likely to be clogged by tobacco particles so that the apparatus can be used for extended intervals of time without any undesirable changes in its mode of operation, e.g., changes which could be brought about by the inability of the surplus of compressed air to leave the channel 4 at the rate it is admitted by the nozzle 42. The remaining air is evacuated from the channel 4 by the suction generating device 38, 41 through the interstices, pores or otherwise configurated openings of the lower reach 2a of the conveyor 2. Such air ensures that the particles T and the particles of the core K adhere to the lower reach 2a during travel in and beyond the tobacco channel 4. As mentioned above, the distribution of holes 37 in the bottom wall 3 of the suction chamber 38 is or can be such that the pressure differential between the interior of the suction chamber 38 and the channel 4 is greater in regions where the particles of tobacco are in the process of impinging upon the underside of the lower reach 2a or on the particles which already adhere to the conveyor 2.

The orientation of tobacco particles T which are to form the first layer L1 can be readily selected in such a way that the underside of the layer L1 is a concave surface CS. This is achieved without resorting to longitudinally extending partitions in the channel 4 and/or without deformation of the lower reach 2a in order to impart to the first tobacco layer the shape of a gutter or trough as taught by the aforediscussed German references. Analogously, the orientation of that portion of the guide face 24 which directs tobacco particles of the second type can be readily selected in such a way that the particles which traverse the portion 4b of the tobacco channel 4 form a core K whose width is less than the distance between the sidewalls 28, 29 and which accumulates on the central portion of the concave surface CS of the first layer L1. Thus, in the apparatus of FIGS. 1 to 5, the core K is formed directly on the first layer L1, i.e., directly on the conveyor 2.

The provision of several staggered portions 24a of the guide face 24 below the portion 4c of the tobacco channel 4 ensures the formation of a highly regular and predictable second layer L2 which overlies the entire core K as well as the marginal portions of the first layer L1 to form with the latter a tubular envelope completely surrounding the core K. This is desirable and advantageous for a number of reasons. For example, if the core K contains short tobacco, such tobacco is much more likely to remain in the central zone of the filler S which is obtained from the fully grown tobacco stream, either with or without trimming. If the fully grown stream is to be subjected to a trimming or equalizing action, the distributor 1c delivers a surplus of tobacco particles T, i.e., the particles are supplied in such quantities that a portion of the second layer L2 must be removed in order to obtain a continuous tobacco filler S which contains optimum quantities of tobacco in each and every increment thereof. The surplus is removed by a trimming or equalizing device 51 which is located downstream of the tobacco channel 4, as viewed in the direction of arrow 8, so that the remainder of the composite stream at the underside of the lower reach 2a of the conveyor 2 constitutes a trimmed filler S which is draped into a continuous web 54 of cigarette paper on the upper reach of an endless belt conveyor 52. The draping mechanism wherein the filler S and the web 54 are converted into a continuous cigarette rod is shown at 53. The details of such draping mechanism form no part of the present invention. The cigarette rod is thereupon subdivided into plain cigarettes of unit length or multiple unit length. Reference may be had to commonly owned U.S. Pat. No. 4,037,608 granted July 26, 1977 to Güunter Wahle which shows a suitable trimming device, a suitable draping mechanism as well as a cutoff which can subdivide the tobacco rod into plain cigarettes of desired length.

An important advantage of the improved method and apparatus is that the first tobacco layer L1 can be formed with a concave surface CS without resorting to deformable conveyors, needles, partitions and other prior art devices which constribute to the cost and complexity of the apparatus and render it more prone to malfunction. The streams of compressed air which are supplied by the nozzle 42 can be directed with a high degree of accuracy so that the propelled particles of tobacco reach selected portions of the conveyor 2 and form thereon a core as well as layers of desired configuration, width and thickness. Such aiming of tobacco particles against selected portions of the air-permeable conveyor is not possible when the particles which travel across the tobacco channel are caused to move exclusively under the action of suction and/or when the particles are propelled exclusively by mechanical means. Since the surplus of compressed air is evacuated upstream of the lower reach **2*a* of the conveyor 2, such compressed air cannot develop eddies and other turbulences which would adversely influence the formation of the layers L1, L2 and/or core K. Moreover, evacuation of surplus air by way of the openings 33 in the recessed portions 23*a*, 28*a* of the sidewall 28 ensures that such evacuation does not adversely influence the trajectories of tobacco particles which are propelled beyond the edge face 27 and travel across the tobacco channel 4 toward the underside of the lower reach 2*a***.

Another important advantage of the improved method and apparatus is that the core K can be formed directly in the tobacco channel 4, i.e., in the region of building the layers L1 and L2. This is possible in spite of the fact that the core K is narrower than the layers L1 and L2 and that such core must be disposed midway between the marginal portions of the layer L1. It has been found that aiming of tobacco particles by streams of compressed air and by properly configurated portions of the guide face 24 renders it possible to direct the particles of tobacco into a very narrow tobacco channel as well as into a predetermined portion of such narrow channel so that the particles which form the relatively thin and narrow core K can be deposited exactly or substantially exactly midway between the sidewalls 28 and 29, i.e., in the deepmost portion of the cavity which is bounded by the concave surface CS of the layer L1. This renders it unnecessary to wrap the layer L1 around the core K.

The feature that the streams of compressed air have a component of movement in the direction (arrow 8) of travel of the lower reach **2*a* of the conveyor 2 (i.e., that the streams of compressed air travel in directions indicated by the arrows 44) contributes to homogeneousness of the tobacco filler S because the particles which impinge upon the lower reach 2*a* and/or upon the particles which already adhere to the lower reach 2*a* are less likely to rebound or otherwise change their positions with reference to the conveyor 2**.

The aforementioned U.S. Pat. No. 4,175,570 already discloses the possibility of withdrawing surplus air through one sidewall of the channel adjacent to an air-permeable conveyor which accumulates a growing tobacco stream. However, this patent does not disclose that the evacuation of surplus air should take place through one or more recessed portions of the one and/or the other sidewall of the tobacco channel so that the evacuation of air in a manner as disclosed in this patent could influence the trajectories of tobacco particles in the tobacco channel. The placing of recessed portions **23*a*, 28*a* immediately downstream of the edge face 27, and the provision of a pronounced outwardly extending ledge (namely, the upper side of the wall portion 23*a*) immediately downstream of the guide face 27, greatly reduces the likelihood that the evacuated surplus air could adversely influence the adjacent trajectory or trajectories of tobacco particles in the channel 4. If desired, the sidewall 29 can also comprise a recessed portion with openings for evacuation of some surplus air. This even further reduces the likelihood of adverse influence of evacuated air upon the trajectories of tobacco particles because the evacuation of surplus air takes place symmetrically at both sides of the channel 4**.

Figure 6:
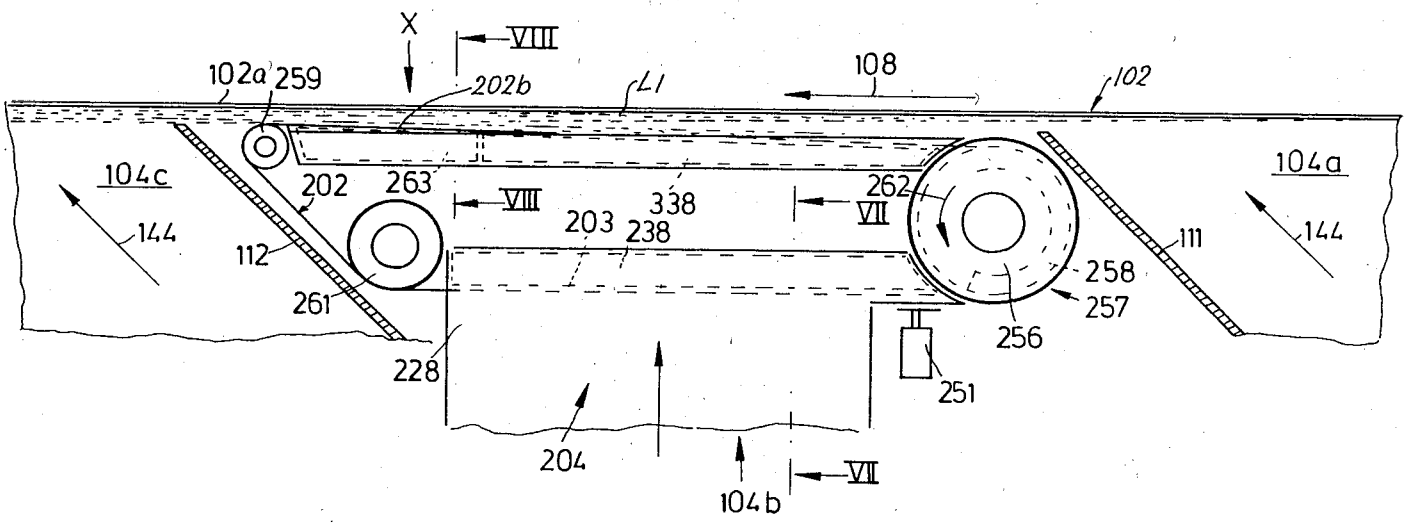
FIG. 6 is a fragmentary schematic longitudinal vertical sectional view of a second apparatus wherein the core of the composite tobacco stream is formed at the underside of a discrete second air-permeable conveyor.
Figure 7:
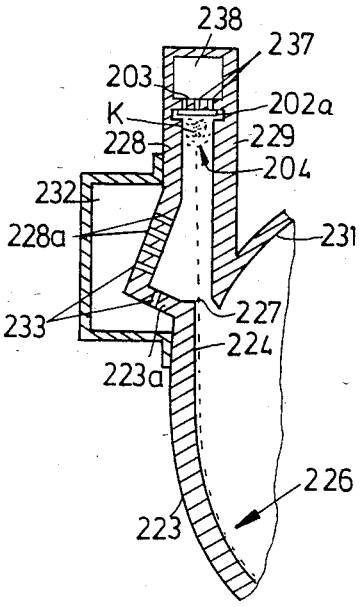
FIG. 7 is an enlarged transverse vertical sectional view as seen in the direction of arrows from the line VII—VII of FIG. 6.
Figure 8:
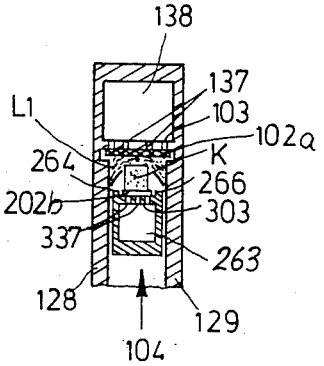
FIG. 8 is an enlarged fragmentary transverse vertical sectional view as seen in the direction of arrows from the line VIII—VIII of FIG. 6.

FIGS. 6 to 8 illustrate a modified apparatus wherein the core K is formed at the underside of the lower reach **202*a* of a second air-permeable belt conveyor 202 which is installed in the section or portion 104*b* of the tobacco channel 104 and defines with two additional sidewalls 228, 229 a discrete second tobacco channel 204. All such parts of the apparatus of FIGS. 6 to 8 which are identical with or clearly analogous to the corresponding parts of the apparatus of FIGS. 1 to 5 are denoted by similar reference characters plus 100. The zone (see FIG. 6) wherein the core K is formed at the underside of the lower reach 202*a* resembles the zone which is shown in FIG. 4. The conveyor 202 is narrower than the conveyor 2 or 102 and its lower reach 202*a* is disposed immediately below the air-permeable bottom wall 203 of a suction chamber 238. The bottom wall 203 has openings 237 in the form of vertical holes which establish a pressure differential between the interior of the suction chamber 238 and the channel 204 to attract to the underside of the lower reach 202*a* those tobacco particles which are to form the core K. The fully grown core K is equalized by a trimming device 251 which is located at the discharge end of the lower reach 202*a* and where the thus obtained trimmed core K enters the circumferentially extending groove 258 of a rotary suction wheel 257 constituting one of the pulleys around which the conveyor 202 is trained in the channel section 104*b*. The conveyor 202 is further trained about pulleys 259 and 261. The trimmed core K has a preferably square or rectangular cross-sectional outline. The suction wheel 257 surrounds a stationary suction chamber 256 which extends along an arc of approximately 180° and ensures that the freshly trimmed core K remains in the groove 258 during travel with the suction wheel 257 and onto the upper reach 202*b* of the conveyor 202. The pulley 259 is installed in the channel section 104*b* rather close to the underside of the lower reach 102*a* of the conveyor 102 (the lower reach 102*a* already carries the first layer L1**).

The major portion of the upper reach **202*b* (namely, the right-hand portion, as viewed in FIG. 6) is disposed above the perforated top wall 303 of a suction chamber 338 which is installed between the reaches 202***a*, 202*b* and establishes a pressure differential between the upper side of the upper reach 202*b* and the underside of the wall 303 via openings 337 in the wall 303. This ensures that the trimmed core K is attracted to the upper reach 202*b* during travel toward the pulley 259. The latter is preceded by a plenum chamber 263 which is adjacent to the underside of the upper reach 202*b* downstream of the suction chamber 338 and serves to urge the trimmed core K upwardly and into the region adjacent to the central portion of the concave surface of the first tobacco layer L1 at the underside of the lower reach 102*a*.

The suction wheel 257 is preferably driven so that the speed of the conveyor 202 matches that of the conveyor 102. The direction in which the wheel 257 is driven is indicated by the arrow 262 which is shown in FIG. 6. The plenum chamber 263 is disposed below a transfer zone X where the core K is transferred from the upper reach 202*b* and adheres to the concave surface of the first tobacco layer L1 on the lower reach 102*a* of the conveyor 102. The levels of the suction wheel 257 and pulley 259 are selected in such a way that the upper reach 202*b* of the conveyor 202 slopes upwardly and to the left, as viewed in FIG. 6, i.e., the distance between the first tobacco layer L1 and the trimmed core K decreases in a direction from the apex of the wheel 257 toward the transfer zone X. This ensures that the upper reach 202*b* gradually lifts the core K out of the channel between the upwardly extending sidewalls 264, 266 which flank the upper reach 202*b* of the conveyor 202. The slope of the upper reach 202*b* is preferably selected in such a way that the trimmed core K is actually pressed against the central portion of the concave surface of the tobacco layer L1 not later than at the pulley 259 so that the core K and the layer L1 then form a coherent mass of tobacco particles which advance into the section or portion 104*c* of the tobacco channel 104 and are covered by the material of the second tobacco layer L2 in the same way as described in connection with FIG. 5. The transfer of the core K onto the central portion of the concave surface of the tobacco layer L1 is assisted by compressed air which issues from the plenum chamber 263 via openings in the top wall of this plenum chamber.

FIG. 7 further shows that the particles of tobacco which are to form the core K are supplied to the channel 204 substantially in the same way as described in connection with FIG. 4. Thus, the sidewall 228 of the channel 204 has two recessed portions 223*a*, 228*a* having openings 233 for evacuation of the major portion of compressed air which is used to advance tobacco particles along the arcuate path 226 at the upper side of the guide wall 223 having a flat guide face 224 terminating at the edge face 227 close to the lowermost portion of the arcuate wall 231. A suction chamber 232 draws excess air from the channel 204 via openings 233 in the recessed wall portions 223*a*, 228*a*.

The apparatus of FIGS. 6 to 8 exhibits the advantage that the core K can be trimmed or equalized prior to deposition of the second tobacco layer L2 thereon, i.e., that each increment of the finished filler contains identical or practically identical quantities of tobacco of the second type.

Commonly owned U.S. Pat. Nos. 3,996,943 (granted Dec. 14, 1976 to Alfred Hinzmann), 3,996,944 (granted Dec. 14, 1976 to Alfred Hinzmann), 3,871,385 (granted May 18, 1975 to Harry David), 4,011,966 (granted Mar. 15, 1977 to Günter Wahle) and 4,235,248 (granted Nov. 25, 1980 to Peter Schumacher) disclose distributors or portions of distributors which can be utilized to supply tobacco particles into the duct 14 or into the corresponding sources of tobacco particles in the apparatus of FIGS. 6–8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of producing a composite tobacco stream on an elongated air-permeable conveyor having first and second sides and longitudinally extending first and second marginal portions, comprising the steps of moving the conveyor lengthwise in a predetermined direction; establishing a pressure differential between the two sides of the conveyor so that air flows from the first to the second side; supplying particles consisting of or containing a first type of tobacco largely onto the marginal portions of the first side of the conveyor whereby the particles are retained by the conveyor as a result of the establishment of said pressure differential and form thereon a first tobacco layer having, as a result of non-uniform distribution of tobacco particles at the first side of the conveyor, a concave surface facing away from the first side; covering a central portion of the concave surface with a core consisting of or containing tobacco particles of a second type and having a width less than that of the first layer so that portions of the concave surface at the opposite sides of the core remain exposed; and applying over the core and over the exposed portions of the concave surface a second layer consisting of or containing tobacco particles of the first type so that the core is at least substantially confined between the two layers.

2. The method of claim 1, wherein said supplying step comprises transporting tobacco particles of the first type in streams of compressed air and directing the streams of compressed air largely toward the marginal portions of the first side of the conveyor.

3. The method of claim 1, wherein said supplying step comprises directing particles of tobacco against the first and second marginal portions of the one side of the conveyor at first and second locations which are disposed one after the other, as considered in said direction.

4. The method of claim 3, further comprising the step of intensifying the flow of air through the conveyor at said locations.

5. The method of claim 1, wherein said covering step includes showering tobacco particles of the second type and attracting the thus showered tobacco particles of the second type to the conveyor by suction.

6. The method of claim 5, wherein said showering step comprises transporting tobacco particles of the second type in at least one directed stream of compressed air.

7. The method of claim 1, wherein said covering step comprises showering tobacco particles of the second type directly onto the concave surface of the first tobacco layer.

8. The method of claim 1, further comprising the step of forming the core on a second elongated air-permeable conveyor which is narrower than the first conveyor and has first and second sides, including moving the second conveyor lengthwise in a preselected direction, establishing a pressure differential between the two sides of the second conveyor so that air flows from the first to the second side of the second conveyor, and supplying particles of the second type onto the first side of the second conveyor.

9. The method of claim 8, wherein the step of supplying tobacco particles of the second type comprises transporting such particles in at least one stream of compressed air and directing the stream of compressed air toward the first side of the second conveyor.

10. The method of claim 8, wherein said step of supplying tobacco particles of the second type comprises supplying such particles with a surplus and removing the surplus from the core prior to said covering step so that the thus trimmed core has a predetermined cross-sectional outline.

11. The method of claim 8, wherein said covering step comprises transferring the core from the second conveyor onto the concave surface of the first tobacco layer on the first conveyor and pressing the transferred core against the first layer.

12. The method of claim 11, further comprising the steps of establishing a first tobacco channel at the first side of the first conveyor and establishing a second tobacco channel at the first side of the second conveyor, said transferring step including gradually lifting the core out of the second tobacco channel.

13. The method of claim 8, further comprising the step of establishing a tobacco channel at the first side of the second conveyor, said step of supplying tobacco particles of the second type comprising establishing a source of tobacco particles of the second type, introducing particles of the second type from the source into an arcuate path which terminates at the channel short of the first side of the second conveyor, and admitting into the arcuate path streams of compressed air to propel the particles of the second type toward the second conveyor so that each particle of the second type has a trajectory extending across the channel between the arcuate path and the second conveyor.

14. The method of claim 8, wherein the step of supplying tobacco particles of the second type comprises transporting such particles in at least one stream of compressed air toward the first side of the second conveyor and further comprising the steps of establishing a tobacco channel at the first side of the second conveyor and withdrawing some compressed air from the channel along a path other than through the second conveyor.

15. The method of claim 8, wherein the step of supplying tobacco particles of the second type comprises transporting such particles in at least one stream of compressed air and imparting to the stream of compressed air a component of movement in said preselected direction.

16. The method of claim 1, further comprising the step of establishing an elongated tobacco channel at the first side of the conveyor, at least one of said supplying, covering and applying steps including establishing a source of tobacco particles of the respective type, introducing tobacco particles from the source into an arcuate path which terminates at the channel short of the first side of the conveyor, and admitting into the arcuate path streams of compressed air to propel the particles of the respective type toward the conveyor so that each particle of the respective type has a trajectory extending across the channel between the arcuate path and the conveyor.

17. The method of claim 16, further comprising the step of imparting to the streams of compressed air components of movement in said predetermined direction.

18. The method of claim 16, further comprising the step of withdrawing some compressed air from the channel along a path other than through the conveyor.

19. Apparatus for producing a composite tobacco stream, particularly a distributor for use in cigarette rod making machines, comprising an elongated air-permeable conveyor arranged to advance in a predetermined direction and having a first side and a second side and first and second marginal portions; a suction generating device adjacent to said second side and arranged to draw air from said first to said second side; sources of first and second types of tobacco particles; means for supplying tobacco particles of the first type from the respective source largely to the marginal portions of said conveyor so as to form on the first side of said conveyor a first tobacco layer having, as a result of non-uniform distribution of tobacco particles at the first side of said conveyor, a substantially concave surface facing away from said first side; means for covering the central portion of said concave surface with tobacco particles of the second type to thus form on said first layer a core which leaves the marginal portions of said concave surface exposed at the opposite sides of the core; and means for applying over the core and over the marginal portions of said concave surface a second layer containing tobacco particles of said first type.

20. The apparatus of claim 19, further comprising sidewalls defining with said conveyor an elongated tobacco channel having a substantially rectangular cross-sectional outline and adjacent to the first side of said conveyor.

21. The apparatus of claim 20, wherein said supplying means comprises guide means for directing tobacco particles of the first type against the marginal portions of said conveyor and means for advancing tobacco particles of the first type along said guide means, across said channel and toward the marginal portions of said conveyor.

22. The apparatus of claim 21, wherein said guide means includes a first portion arranged to direct tobacco particles of the first type toward the first marginal portion of said conveyor in a first portion of said channel and a second portion arranged to direct tobacco particles of the first type toward the second marginal portion of said conveyor in a second portion of said channel downstream of the first portion, as considered in said direction.

23. The apparatus of claim 22, wherein said suction generating device includes a suction chamber having an air-permeable wall adjacent to the second side of said conveyor, the permeability of said wall adjacent to said marginal portions of said conveyor being greater than the permeability of the remaining portions of said wall in the regions of said first and second portions of said channel so that the suction chamber attracts the oncoming tobacco particles of the first type with a force which is greater than that which attracts tobacco particles already adhering to the first side of said conveyor.

24. The apparatus of claim 23, wherein the wall of said suction chamber has holes and the number of holes per unit area of those portions of said wall which register with said marginal portions exceeds the number of holes per unit area of the remaining portions of said wall in register with the first and second portions of said channel.

25. The apparatus of claim 20, wherein said covering means comprises guide means arranged to direct tobacco particles of the second type against the central portion of said concave surface substantially midway between said marginal portions and means for propelling tobacco particles of the second type from the respective source along said guide means and toward the central portion of said concave surface.

26. The apparatus of claim 20, wherein said covering means comprises a second air-permeable conveyor arranged to advance in a preselected direction and having first and second sides, a second suction generating device arranged to draw air from the first to the second side of said second conveyor, means for delivering tobacco particles of the second type from the respective source to the first side of said second conveyor, and means for transferring the core including tobacco particles of the second type from the second conveyor onto the central portion of the concave surface of the first tobacco layer on the first side of said first conveyor.

27. The apparatus of claim 26, wherein said transferring means is disposed downstream of said supplying means, as considered in said predetermined direction.

28. The apparatus of claim 26, wherein said delivering means includes guide means defining a path for the transport of tobacco particles of the second type from the respective source toward the first side of said second conveyor and means for transporting tobacco particles of the second type along said path, and further comprising sidewalls defining with said second conveyor a second tobacco channel adjacent to the first side of the second conveyor.

29. The apparatus of claim 26, wherein said delivering means comprises means for delivering a surplus of tobacco particles of the second type and further comprising a trimming device arranged to remove the surplus of tobacco particles from the core on said second conveyor.

30. The apparatus of claim 26, further comprising second sidewalls defining with said second conveyor a second tobacco channel which is adjacent to the first side of said second conveyor, said transferring means including means for advancing a portion of said second conveyor along a path which extends in said predetermined direction and for causing said conveyors to converge and to thus effect the transfer of the core from the second conveyor onto the central portion of said concave surface.

31. The apparatus of claim 30, wherein said advancing means comprises means for gradually expelling the core from said second tobacco channel.

32. The apparatus of claim 30, wherein said second conveyor includes an endless flexible band having a first reach which is adjacent to said second tobacco channel and a second reach which is adjacent to the first side of said first conveyor.

33. The apparatus of claim 32, wherein the second reach of said band extends into the channel which is adjacent to the first side of said first conveyor.

34. The apparatus of claim 26, wherein said transferring means includes a plenum chamber.

35. The apparatus of claim 20, wherein at least one of said supplying, covering and applying means comprises a source of compressed air and means for directing streams of compressed air from the respective source into the path of tobacco particles which are supplied by the respective tobacco source or sources.

36. The apparatus of claim 35, wherein said directing means comprises means for imparting to the streams of compressed air a component of movement in said predetermined direction.

37. The apparatus of claim 35, further comprising guide means defining for the particles of tobacco an arcuate path extending from the respective tobacco sources to said tobacco channel but short of the first side of said conveyor, the trajectories of tobacco particles between said arcuate path and said conveyor extending tangentially of said arcuate path and terminating at selected portions of the first side of said conveyor.

38. The apparatus of claim 37, wherein said selected portions include said marginal portions of the conveyor and the conveyor portion which is adjacent to the central portion of said concave surface.

39. The apparatus of claim 35, wherein at least one of said sidewalls has at least one outwardly recessed air-permeable portion arranged to permit evacuation of some compressed air from said tobacco channel.

40. The apparatus of claim 39, further comprising a suction chamber outwardly adjacent to the recessed portion of said one sidewall and arranged to draw air from said tobacco channel.

* * * * *